United States Patent [19]

Tenney

[11] 4,013,396

[45] Mar. 22, 1977

[54] FUEL AEROSOLIZATION APPARATUS AND METHOD

[76] Inventor: William L. Tenney, Crystal Bay, Minn. 55323

[22] Filed: Aug. 25, 1975

[21] Appl. No.: 607,716

[52] U.S. Cl. ..... 431/11; 431/2; 431/115; 431/208; 431/215

[51] Int. Cl.[2] ..... F23D 11/44

[58] Field of Search ..... 431/2, 10, 11, 208, 431/9, 115, 116, 215

[56] References Cited

UNITED STATES PATENTS

| | | | |
|---|---|---|---|
| 1,874,341 | 8/1932 | Osthoff | 431/11 |
| 3,326,262 | 6/1967 | Weller et al. | 431/11 X |
| 3,756,764 | 9/1973 | Reichmann | 431/208 X |
| 3,876,363 | 4/1975 | La Haye et al. | 431/11 |
| 3,885,904 | 5/1975 | Feng | 431/11 |

*Primary Examiner*—Edward G. Favors
*Attorney, Agent, or Firm*—Burd, Braddock & Bartz

[57] ABSTRACT

An apparatus and method for vaporizing and subsequently aerosolizing combustible fuel for use in a heating burner. Vaporized fuel is dispensed into a condensation area to form an aerosol fuel mixed with air. The aerosol fuel has relatively even sized particles which are generally less than 1 micron in diameter. The aerosol fuel is further mixed with air to provide a desired air-to-fuel ratio for use in the combustion area of a heating burner.

41 Claims, 12 Drawing Figures

FUEL AEROSOLIZATION APPARATUS AND METHOD

BACKGROUND OF INVENTION

Liquid petroleum fuels, as butane and octane hydrocarbons, must be vaporized before they can be burned. Vaporizing burners are used to accomplish vaporization by direct heating of the liquid fuel. Examples of vaporizing burners are blow torches, gasoline stoves, wick-type burners and early domestic burners, wherein oil is vaporized from a flame heated plate.

Other types of oil burners use two steps to change the liquid fuel into a combustible form. The steps are (1) atomization of the fuel and (2) vaporization of the atomized fuel. Atomization of the fuel exposes large surface areas of the fuel to air and heat with the result that there is a rapid vaporization of the fuel. The heated air vaporizes the atomized fuel. The atomization is normally accomplished by forcing the liquid fuel through a nozzle and mixing the fuel discharged from the nozzle with heated air. The mixing of the fuel with the air is normally done in the combustion area of the burner. Baumanns et al., in U.S. Pat. No. 3,199,568 disclose an oil heater having a conduit subjected to heat to vaporize fuel in the conduit. The vaporized fuel is mixed with hot air and delivered to a burner plate. Combustion occurs outside the burner plate.

Oil vaporizer and burner units have been designed over the years to vaporize oils prior to combustion of the oil. Makinson disclosed in 1910 in U.S. Pat. No 973,526 an apparatus having a fuel line being heated to vaporize liquid fuel prior to burning. Improvements in Makinson's apparatus are disclosed by Wirth in 1915 in U.S. Pat. No. 1,138,165; Metcalfe in 1922 in U.S. Pat. No. 1,402,243; Rosier in 1927 in U.S. Pat. No. 1,614,045; Astradsson in 1940 in U.S. Pat. No. 2,216,178 and Moench in 1974 in U.S. Pat. No. 3,840,321.

Centrifugal atomizing burners are used to break the liquid fuel into small particles. These burners utilize a rotating disc, cup, or other rotating member for atomizing the liquid fuel. Centrifugal force throws the liquid fuel from the lip of the cup to form a sheet of liquid which quickly breaks into a spray. Low pressure air may be admitted through the space around the cup to produce a wide angle spray. The atomized fuel is heated to vaporize the fuel prior to burning of the vapor fuel.

SUMMARY OF INVENTION

The invention is directed to a liquid hydrocarbon fuel handling and control system for a fuel-using apparatus. More particularly, the fuel system of the invention converts gasoline or other liquid hydrocarbon fuel to a gaseous state in the form of an aerosol having relatively even size particles which are generally less than 1 micron in diameter.

The apparatus for vaporizing and aerosolizing fuel for use in a combustion area has a first means for receiving liquid fuel and vaporizing the fuel. The vaporized fuel is discharged into a second means operable to condense the vaporized fuel to aerosol fuel by rapidly mixing the vapor phase fuel with air. The aerosol fuel is further mixed with air to achieve the desired fuel-to-air ratio and delivered to the combustion area. The first means can be a tubular coil subjected to a controlled amount of heat, a tube subjected to a controlled amount of heat, or the use of hot gases directly to elevate the temperature of the liquid fuel above its boiling point. The second means includes means for receiving the hot fuel in a vapor state and delivering and mixing air with the vapor fuel to rapidly condense the fuel to an aerosol fuel. The aerosol fuel is in the nature of a gas which has a white colored appearance. The aerosol fuel is comprised of small fuel particles which are generally less than 1 micron in diameter and are evenly dispersed in the air. Preferably, the majority of the fuel particles have a diameter less than 1 micron. Sufficient air is provided to the fuel-air mixture to achieve a desired fuel-to-air ratio. The aerosol fuel is then burned in a combustion area.

An object of the invention is to provide an apparatus and method for converting liquid hydrocarbon fuel into aerosol fuel having relatively even sized particles which are usually less than 1 micron in diameter. Another object of the invention is to provide small particle aerosol fuel for a burner in a form whereby the burning of the aerosol fuel with a minimum of excess air will produce a minimum of soot and pollutant emissions and improve overall fuel economy. A further object of the invention is to provide an apparatus and method of aerosolizing liquid fuels which can accommodate heavy fuel oils in a manner so that heavy fuel oils burn with greater efficiency than achieved in conventional combustion systems. Yet another object of the invention is to provide a combustible fuel handling apparatus and method that is used in a combustion process and has a high thermal efficiency and a minimum of pollutant emissions. Another object of the invention is to provide a fuel flow and handling system operable to provide an air and hydrocarbon fuel mixture with the fuel being in the form of a visible, generally white, non-wetting fog or aerosol fuel that is composed of particles that remain in suspension and do not exhibit particle growth.

In the drawings

DESCRIPTION OF PREFERRED EMBODIMENTS

Figure 1:
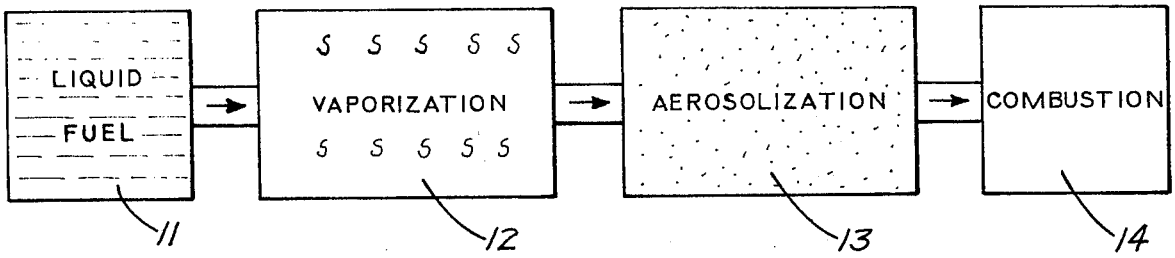
FIG. 1 is a block diagram of the method of the invention for vaporizing and aerosolizing combustible fuel.

Referring to FIG. 1, there is shown a block diagram of the method of vaporizing and aerosolizing combustible fuel for combustion in a combustion chamber. A liquid fuel 11, as a hydrocarbon fuel, including gasoline, kerosene and fuel oil, is moved to a vaporization unit and changed to vapor 12 in a vaporization process. The vapors 12 flow to an aerosolization area wherein the vaporized fuel is condensed by rapid mixing with air into an aerosol fuel 13 wherein the aerosol fuel particles have diameters which are generally less than 1 micron. The aerosol fuel particles are relatively even in size and have generally uniform distribution in the carrier gas, as air. Preferably, the aerosol has a median particle size of about 0.6 micron in diameter and is in the nature of a dry, visible white gas. Sufficient air is provided to the aerosol fuel-air mixture to achieve a desired fuel-to-air ratio. The aerosol fuel is then delivered to a combustion area 14 where it is burned.

Figure 2:
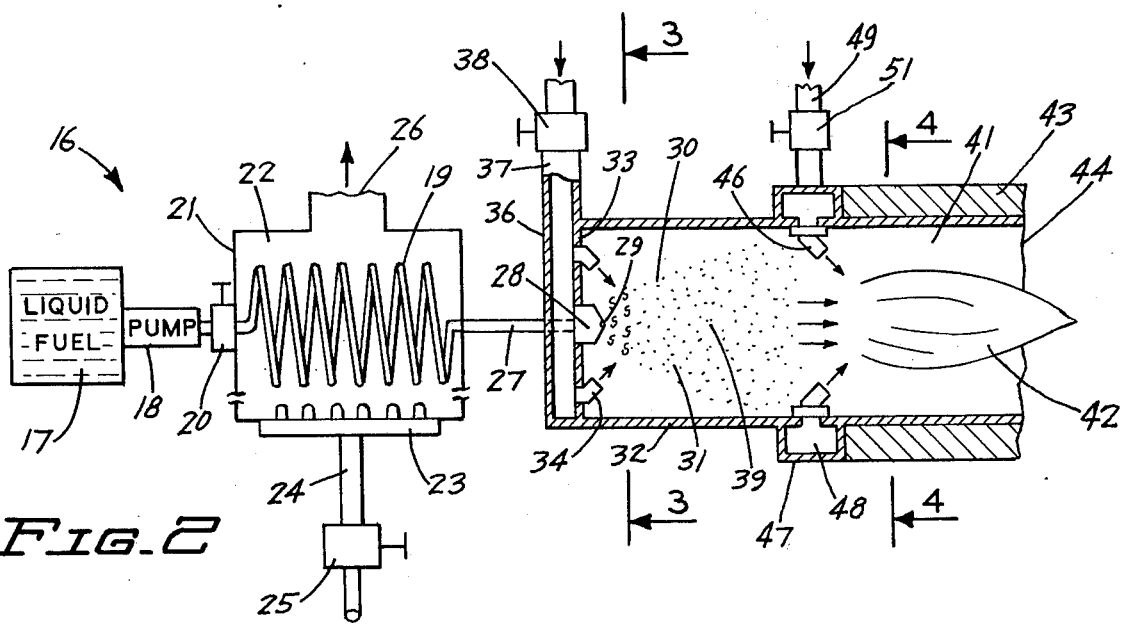
FIG. 2 is a diagrammatic view, partly sectioned, of a tube coil type apparatus for vaporizing and aerosolizing combustible fuel.
Figure 3:
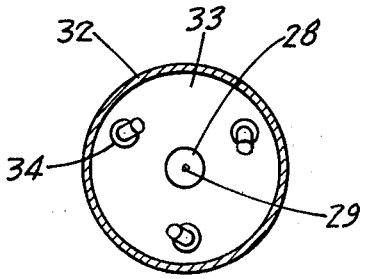
FIG. 3 is a sectional view taken along line 3—3 of FIG. 2.
Figure 4:
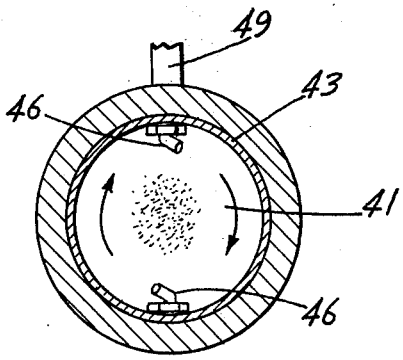
FIG. 4 is a sectional view taken along line 4—4 of FIG. 2.

Referring to FIGS. 2–4, there is shown a tube coil type apparatus indicated generally at 16 which embodies the method of vaporizing, aerosolizing and burning hydrocarbon fuel. Apparatus 16 comprises a liquid fuel source 17, as a tank or container, for storing liquid hydrocarbon fuel. A pump 18 moves the liquid fuel from the source 17 into a tubular coil 19. Air pressure or other means can also be used to move the liquid fuel from source 17 into tubular coil 19. Water can be mixed with the fuel or introduced by pump 18 into coil 19. The water lowers the boiling temperature of the fuel and thereby reduces the amount of heat necessary to attain vaporization temperature. The amount of water used can vary. In some cases, up to 10% of the liquid in coil 19 can be water. An adjustable valve 20 controls the rate of flow of fuel pumped into coil 19, or a fixed size orifice can be used in lieu of valve 20 to control the rate of flow of fuel supplied to coil 19. Coil 19 carries the fuel through a housing 21 having a chamber 22 for accommodating the coil 19. A burner 23 located in chamber 22 functions to heat the coil 19 and increase the temperature of the liquid fuel above its boiling or vaporizing point. The temperature of the liquid fuel is maintained slightly above the boiling point of the fuel by control of the fuel flow rate and burner heat output rate. The liquid fuel, being under sufficient pressure, does not vaporize in coil 19. Burner 23 is attached to a gas supply line 24 whereby the burner operates to heat the coil 19. A gas flow valve 25 in line 24 is used to regulate the amount of flame of burner 23. The amount of the flame is maintained to produce a heat output sufficient to elevate the temperature of the liquid fuel above its vaporizing or boiling point. The BTU output is controlled to provide sufficient heat to vaporize the liquid fuel but not sufficient to crack or otherwise break down the fuel. Housing 21 has an exhaust vent 26 providing an exit for exhaust gases from the chamber 22. Other types of heating structures can be used to supply heat energy to coil 19. For example, hot exhaust gases from an internal combustion engine or hot gases from other types of combustion devices can be used to heat coil 19.

The coil 19 is joined to a line or pipe 27 which carries the hot fuel to a nozzle 28. Pipe 27 may be insulated to conserve heat energy of hot fuel. The nozzle 28 has one or more small discharge openings 29, as shown in FIG. 3, for directing a pattern or stream of vaporized fuel 30 into an aerosolization chamber 31. The hot liquid fuel is discharged from nozzle 28 as a vapor fuel because of the reduction of the pressure of the fuel externally of nozzle 28. The fuel may flow from nozzle 28 with a velocity in the range of sonic velocity. The rapidly moving and expanding fuel is mixed with air in chamber 31 formed by a housing or casing 32 having an end wall 33.

As shown in FIGS. 2 and 3, a plurality of air or gas nozzles 34 are mounted on end wall 33. Three nozzles 34 equally spaced from each other are mounted on end wall 33. The nozzles 34 have discharge ends that direct air under pressure in a circumferential direction into the chamber 31. In use, nozzles 34 function to force the air in a rotating or spiral pattern through chamber 31. If desired, nozzles 34 can be positioned to introduce air in a non-rotating or non-spiral pattern into chamber 31. An air manifold 36 is mounted on the outside of end 33 to supply air to nozzles 34. An air supply pipe 37 delivers air to the manifold 36. A control valve 38 mounted in pipe 37 is operable to control the amount of air delivered to the manifold 36 sufficient for rapid mixing and condensation of the vapor fuel. Sufficient air can be introduced into the chamber 31 to condense the vapor fuel and provide the desired fuel-to-air ratio. The air discharged from nozzles 34 is preferably at ambient temperature. Manifold 36 can be replaced with one or more openings whereby outside air is sucked into chamber 31 by the rapidly moving vaporized fuel. This air is rapidly mixed with the expanding vapor fuel to cause condensation of the vapor fuel to aerosol fuel.

The air being introduced into chamber 31 causes rapid mixing of the vaporized fuel with the air and condensation of the vaporized fuel into aerosol fuel particles having relatively even size particles that are generally less than 1 micron in diameter. Preferably, the aerosol particle size is in the range of 0.6 micron in diameter. The aerosol fuel is in the nature of a visible white gas and is uniformly mixed with the air being introduced into chamber 31. The mixture of air and aerosol fuel moves in a spiral pattern in a longitudinal direction into a combustion chamber 41 where the fuel is burned. The combustion chamber 41 is axially aligned with the aerosolization chamber 31 and constitutes the area where the combustion flame 42 is localized. Combustion chamber 41 is surrounded with a wall 43 of ceramic or other heat resistant material and has an outlet 44. Wall 43 can be part of a heat exchanger or replaced with a heat exchanging unit.

Additional air can be supplied to combustion chamber 41 with a plurality of nozzles 46 to achieve the desired fuel-to-air ratio. Nozzles 46 direct the air toward the center and in a circumferential direction into combustion chamber 41. An annular manifold 47 having an annular chamber 48 carries the air to the nozzle 46. The manifold 47 is connected to a supply pipe 49. A control valve 51 located in supply pipe 49 is used to control the supply of air to the manifold 47 to regulate the fuel-to-air ratio. The additional air can be supplied by mechanical pumping means or aspiration. If desired, the air can be introduced into the combustion chamber in a direction that does not produce a rotating air flow pattern. A suitable means, as an igniter or spark plug (not shown), may be used to ignite the aerosol fuel in the combustion chamber.

Figure 5:
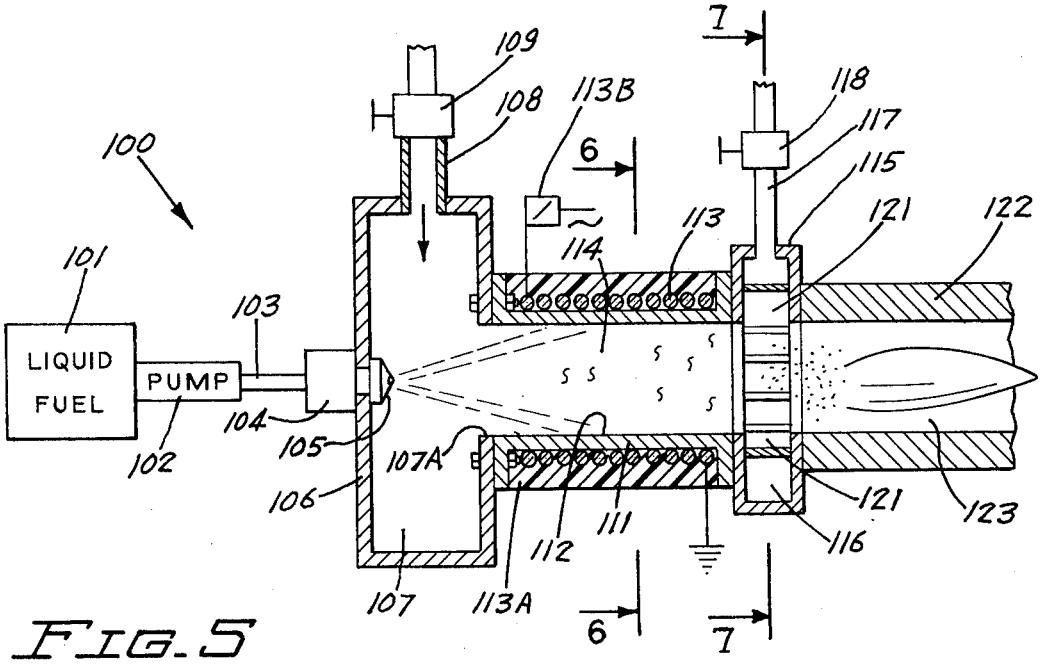
FIG. 5 is a diagrammatic view, partly sectioned, of a heated tube apparatus for vaporizing and aerosolizing combustible fuel.
Figure 6:
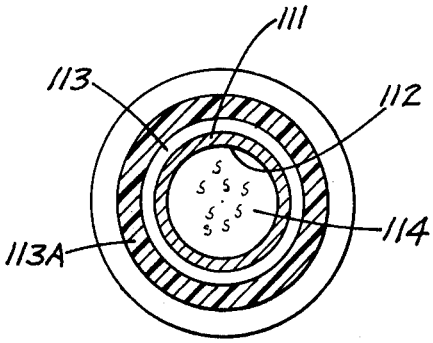
FIG. 6 is a sectional view taken along line 6—6 of FIG. 5.
Figure 7:
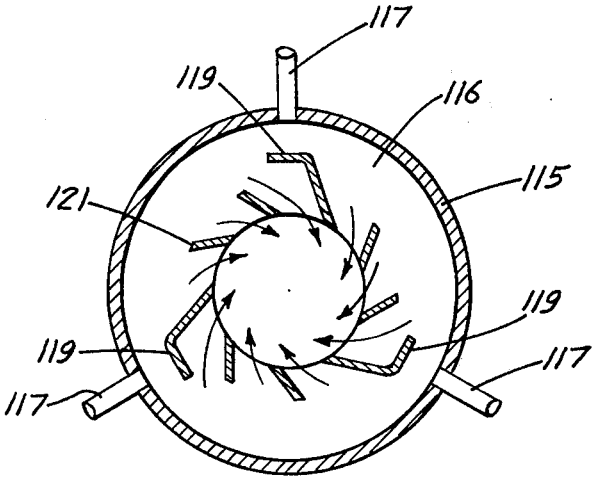
FIG. 7 is an enlarged sectional view taken along line 7—7 of FIG. 5.

Referring to FIGS. 5–7, there is shown a heated tube apparatus and method for vaporization and aerosolization of combustible liquid hydrocarbon fuel. The apparatus indicated generally at 100 is connected to a liquid fuel source 101, such as a tank, containing liquid hydrocarbon fuel, as gasoline, fuel oil, kerosene or the like. Pump 102 moves fuel from the source 101 and discharges the fuel into a pipe or line 103. Air pressure or other means can also be used to move the liquid fuel from source 101 to nozzle 105. Line 103, having a control valve 104, is connected to a spray nozzle 105. Nozzle 105 is mounted on a manifold or housing 106. Housing 106 has an internal chamber 107 with an outlet opening 107A. The fuel discharge portion of nozzle 105 is mounted on housing 106 in axial alignment with the opening 107A. An air inlet line or pipe 108 is mounted on the housing 106 and delivers air under pressure into the chamber 107. The amount of air delivered to chamber 107 is controlled with a valve 109 mounted in pipe 108. Housing 106 can also be provided with one or more holes whereby air is sucked into chamber 107 and mixed with fuel moving through chamber 114.

An elongated cylindrical tube 111 is mounted on housing 106 in axial alignment with the opening 107A. Tube 111 has an inside cylindrical wall 112 which forms a cylindrical surface 112 toward which the fuel spray discharges from nozzle 105. A heating coil 113 is wrapped around the outside of tube 111. The heating coil 113 can be an electrical coil operable to heat tube 111 to a temperature whereby the liquid particles that are sprayed toward surface 112 are vaporized. A heat insulating jacket or cover 113A surrounds coil 113. The temperature of coil 113 is regulated with a control unit 113B, as a thermostat or the like. Control unit 113B can sense the temperature of the tube 111 and maintain the tube at a temperature sufficient to vaporize the liquid fuel introduced into chamber 114. The maintained temperature is not excessive so as to cause breakdown of the fuel. The vapor fuel is shown as short, wave-like lines in FIG. 5. The aerosol fuel is shown as dots in FIG. 5. Other types of heating structures can be used to heat the tube 111 to a temperature which will vaporize the fuel being sprayed toward the surface 112.

Tube 111 forms an elongated cylindrical vaporization chamber 114 which carries the vaporized fuel. A casing 115 is attached to tube 111. Casing 115 has an annular channel 116 for receiving air from a plurality of air inlet pipes 117. As shown in FIG. 7, air inlet pipes 117 are mounted on casing 115 and are circumferentially spaced from each other. The air moving through the pipes 117 is controlled with a valve 118. Located in the channel 116 are vanes or blades 119 which deflect the air discharged by pipes 117 in a circumferential direction around annular channel 116 and angularly deflect the air moving in channel 116 to the central passage of the casing 115 to rapidly mix the air with the vaporized fuel. The air mixing with the vaporized fuel condenses the vaporized fuel to form aerosol fuel. The aerosol fuel and dilution carrier air moves into a combustion chamber 123 formed by tubular casing 122 where the fuel is burned. The chamber 123 is in axial alignment with the vaporization chamber 114. Casing 122 can be replaced with a suitable heat exchanger.

In use, the apparatus 100 uses pump 102 to move the liquid fuel from the container or source 101 to the nozzle 105. The fuel, being under pressure in the nozzle, is discharged at a high velocity through the nozzle opening as a fine, cone-shaped spray into chamber 114. Coil 113 supplies a constant source of heat to the tube 111. The tube 111 is at a temperature sufficient to vaporize the fuel as it meets with surface 112. The temperature of the tube 111 is regulated with control unit 113B to maintain a temperature that will provide sustained vaporization of the fuel in chamber 114. Thus, the rate of heat input is regulated by control unit 113B in accordance with the controlled rate of fuel input through nozzle 105.

Air is supplied through pipe 108 to the manifold chamber 107. The air moves with the fuel through the vaporization chamber to rapidly mix the air with the vaporized fuel. Pipe 108 can be tangentially positioned so that the air moves in a circular path in chamber 107. This provides even and rapid mixing of the air with the fuel moving through chamber 114. The mixture of air and vaporized fuel moves through the opening surrounded by the casing 115. Additional air can be supplied to and mixed with the vaporized fuel. This additional air is at a temperature, preferably ambient temperature, which is sufficient to condense the vaporized fuel into an aerosol phase. The aerosol fuel has relatively even size particles and uniform particle distribution with the particles being generally less than 1 micron in diameter. The aerosol fuel is in the nature of a visible white gas. Preferably, the majority of the particles have a diameter of less than 1 micron. The aerosol fuel and air mixture is delivered to the combustion chamber 123 where it is burned. A suitable means, as an igniter or spark plug (not shown), may be used to ignite the aerosol fuel in the combustion chamber. The air-to-fuel ratio of the mixture delivered to chamber 123 is controlled via valve 118. Valve 118 controls the amount of air discharged into annular chamber 116. The rate of fuel flow is regulated by suitable controls on pump 102, regulation of valve 104, or the orifice size of nozzle 105.

Figure 8:
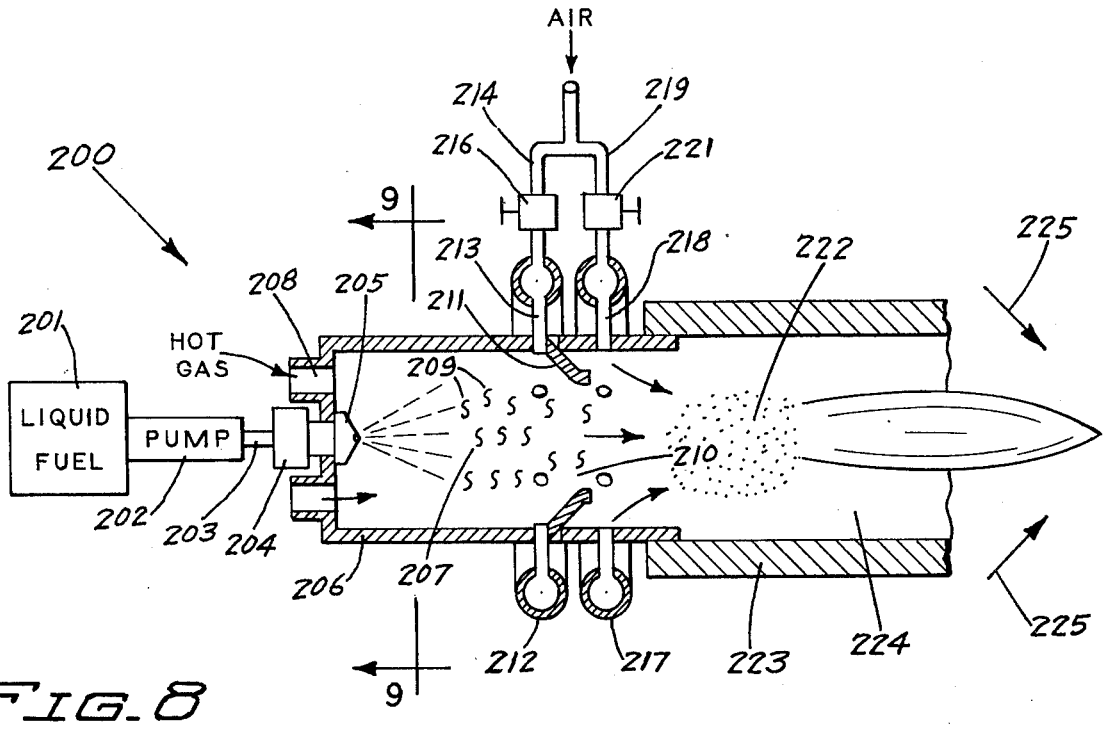
FIG. 8 is a diagrammatic view, partly sectioned, of a hot gas apparatus for vaporizing and aerosolizing combustible fuel.
Figure 9:
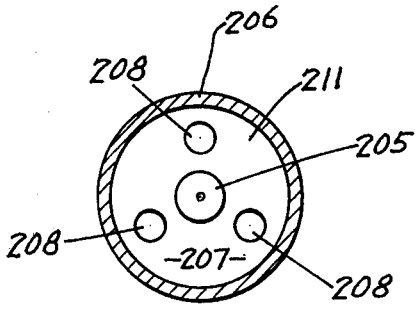
FIG. 9 is a sectional view taken along line 9—9 of FIG. 8.

Referring to FIGS. 8 and 9, there is shown a hot gas type apparatus for vaporizing and aerosolizing liquid hydrocarbon fuel and delivering the fuel to a combustion area. An apparatus indicated generally at 200 has a fuel source 201, as liquid hydrocarbon fuel in a storage tank. A pump 202 or air pressure operates to move the fuel from the fuel source into a line or pipe 203. Pipe 203 is connected to a control valve 204, as an adjustable needle valve or a fixed sized orifice valve. Valve 204 operates to control the amount of liquid fuel supplied under pressure to nozzle 205. An elongated tubular housing 206 has a vaporization area 207 for receiving the fuel discharged from the nozzle 205. Nozzle 205 is mounted on the end wall of housing 206 so that the fuel discharged by nozzle 205 is directed in a spray pattern along the longitudinal direction of vaporization area 207. Hot gas inlets 208 secured to the end wall of housing 206 are operable to deliver hot gases at suitably high velocity to area 207. Inlets 208 are operable to deliver the hot gases in a circular or spiral pattern to vaporization area 207, if desired. The hot gases an be the exhaust gases of an internal combustion engine, combustion burner or other hot gas source. Other types of hot gases can also be used to vaporize the fuel (shown as short S lines 209) discharged into area 207 via the nozzle 205. The amount of BTU of the hot gas and temperature of the hot gas introduced into vaporization area 207 is provided sufficient to vaporize the fuel dispensed by nozzle 205 in accordance with the rate of the fuel is discharged through the nozzle. The vaporized fuel 209 moves through a venturi throat 210 formed in a cone-shaped end member 211. In some structures, venturi throat 210 can be removed by removing cone-shaped member 211. Member 211 is mounted on the housing 206. A first air manifold 212 surrounds housing 206. A plurality of pipes or tubes 213 connect manifold 212 with the housing 206 to deliver air under pressure into area 207. An air inlet or supply line 214 is connected to the manifold 212 to deliver air under pressure to the manifold. A control valve 216 or other suitable control means in line 214 controls the amount of air supplied to the manifold.

A second manifold 217 is connected with a plurality of pipes 218 to the housing. Pipes 218 have discharge openings downstream of the member 214. An air supply line 219 delivers air under pressure to manifold 217. A control valve 221 operates to control the amount of air delivered to manifold 217. The vaporized fuel and air are mixed in the area of venturi throat 210 to condense the vaporized fuel into aerosol fuel in an aerosol area 222. The aerosol fuel is shown as a series of dots in area 222. The aerosol fuel has relatively even sized particles, the majority of particles having a diameter of less than 1 micron. The aerosol fuel is thus in the nature of a visible white gas. The aerosol fuel flows downstream into a combustion area 224. A suitable means, as an igniter or spark plug (not shown), may be used to ignite the aerosol fuel in the combustion chamber. A casing 223 of ceramic or like material surrounds the combustion area 224. Casing 223 can be a heat exchanger. Part of the air can be supplied to combustion area 224 from an external source, as shown by arrows 225.

Figure 10:
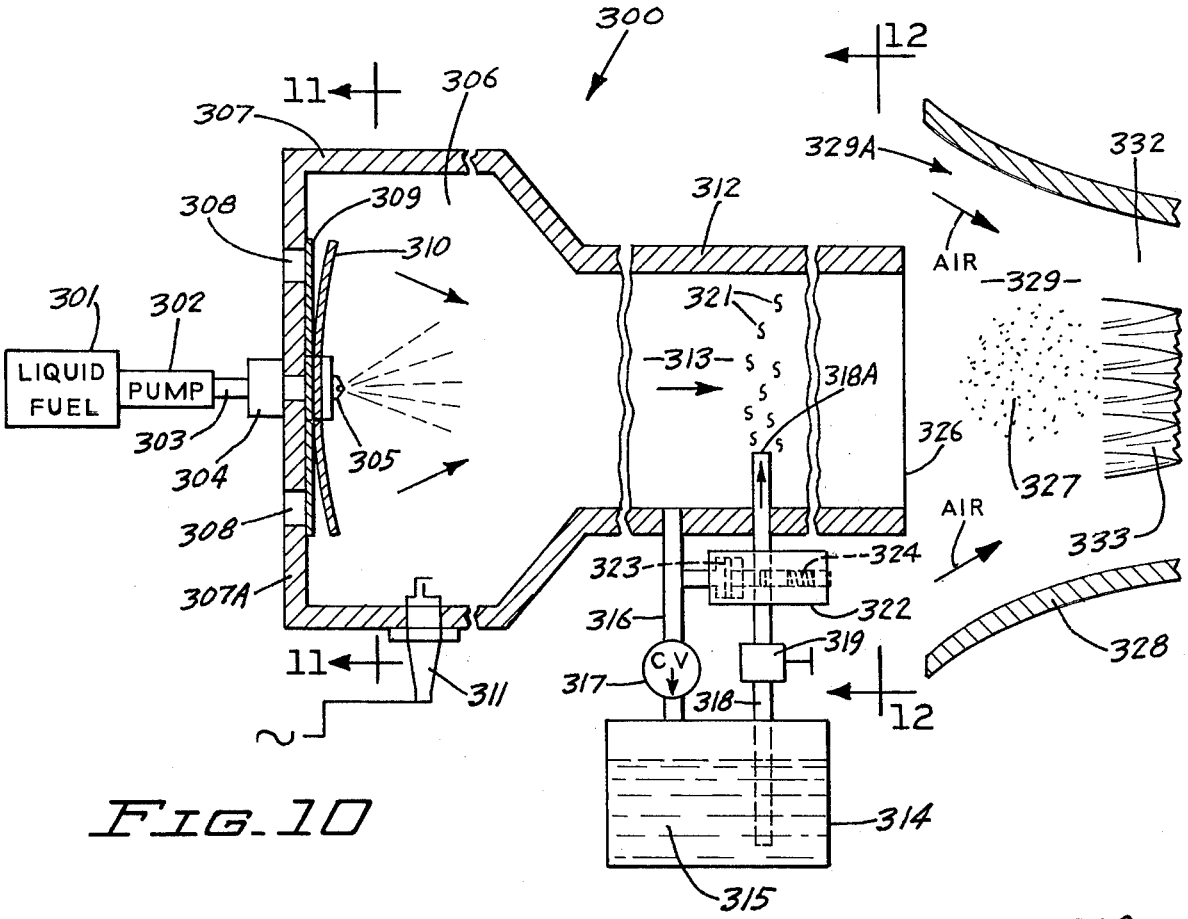
FIG. 10 is a diagrammatic view, partly sectioned, of a pulse jet apparatus for vaporizing and aerosolizing combustible fuel.
Figure 11:
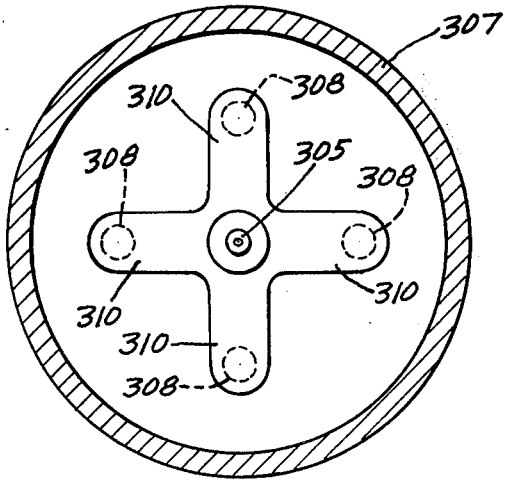
FIG. 11 is a sectional view taken along line 11—11 of FIG. 10.
Figure 12:
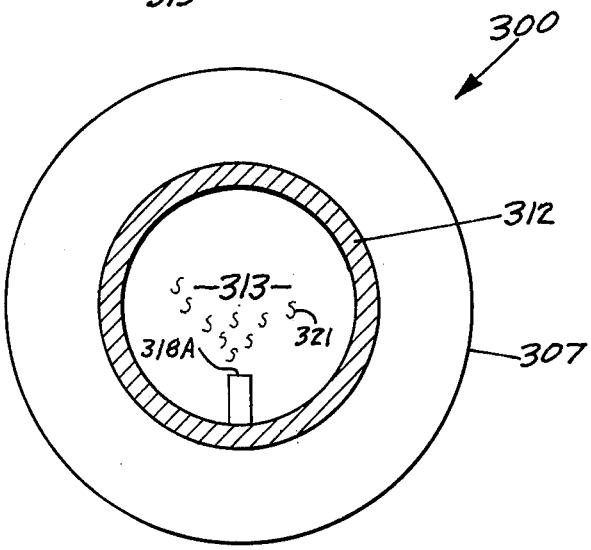
FIG. 12 is a sectional view taken along line 12—12 of FIG. 10.

Referring to FIGS. 10, 11 and 12, there is shown a pulse jet type apparatus indicted generally at 300 for vaporizing and aerosolizing fuel according to the invention. The apparatus 300 has a hydrocarbon fuel source 301. A pump or other pressure source 302 moves the fuel from source 301 into a line 303. Line 303 is connected to a fuel flow control 304, as an adjustable needle valve or a fixed size orifice.

The nozzle 305 connected to control 304 functions to discharge a charge of atomized fuel into an enclosed chamber 306. The chamber 306 is formed with a housing 307 having an end member 307A. An air intake means 308, as a plurality of inlet openings or holes, is located in end wall 307A and functions to deliver a charge of air into chamber 306. A one-way valve assembly 309, such as a reed valve structure, may be located in chamber 306 to minimize the reverse or backflow of fluid and air from chamber 306 through air intake means 308. A stop 310 limits the opening of valves 309. Other types of air control valves can be used to limit reverse flow of air and combustion gases from chamber 306. In some designs, a valveless type of pulse jet apparatus can be utilized.

The fuel and air mixture in chamber 306 is ignited for starting purposes with an igniter 311, as a spark plug. Once the combustion process is started, the intermittent combustion of the charges of atomized fuel dispensed into chamber 307 will continue to ignite as long as fuel is discharged into chamber 306. Examples of pulse jet devices are disclosed by Tenney in U.S. Pat. Nos. 2,738,334; 2,768,031; 2,821,986 and 2,857,332.

An elongated tube 312 having a longitudinal passage 313 is secured to the end of housing 306. The ignited fuel charges in chamber 306 expand and flow through passage 313 as hot gases at very high velocity to the combustion area 329. Also, this gas flow is of a high frequency pulsating and reciprocating nature.

A tank 314 stores the hydrocarbon fuel 315, as gasoline, diesel fuel, fuel oil, kerosene and the like. The top of tank 314 is connected with a line 316 to the passage 313. A one-way check valve 317 is located in line 316 to provide a sufficiently high pressure in the tank 314. The pressure of the combustion gases in passage 313 forces gases through line 316 and check valve 317 into tank 314. A second line 318 connects the bottom of the tank 314 to the passage 313. The pressure of the gases in the top of tank 314 forces the liquid fuel through line 318 and into vaporization area 313. The liquid fuel entering the passage 313 is broken down into small particles or atomized by fast moving gases. The atomized fuel is then vaporized into its vapor phase by heat from the combustion gas in passage 313. A control valve 319, as a needle valve, fixed orifice valve or the like, interposed in line 318 functions to control the rate of flow of fuel through line 318 and into atomization and vaporization passage 313. Valve 319 is adjusted so as not to exceed the amount of fuel which can be vaporized by the BTU content of the hot gases generated by the pulse jet apparatus. Preferably, the location of outlet 318A of line 318 is at a point in passage 313 wherein the temperature of the gases in passage 313 does not crack or break down the fuel. The heat of the combustion gases moving through passage 313 is sufficient to vaporize the fuel. The vaporized fuel 321, shown as short S lines, flows through passage 313. A second valve or automatic shut-off valve 322 in line 318 functions to stop the flow of fuel in line 318 when the gas pressure in passage 313 is below a predetermined level. This prevents excess fuel from being discharged into passage 313 when the apparatus is shut down. Valve 322 has a spring biased piston 323 that moves in response to gas pressure in line 316 to open line 318. When gas pressure in line 316 is below a predetermined level, the spring 324 will move piston 323 to its closed position, thereby blocking the flow of fuel in line 318.

As shown in FIGS. 10 and 12, tube 312 has an exit end 326 located in an area surrounded by a cone-shaped member 328. Member 328 has a passage 329 open at one end 329A to the atmosphere and connected at the other end to the combustion area 333. Air enters passage 329 and rapidly mixes with the vapor phase fuel discharged from tube 312. The air condenses the vaporized fuel 321 to form aerosolized fuel 327, shown as a series of dots. The aerosolized fuel has relatively uniform particle size and a substantial number of particles with diameters of less than 1 micron. Preferably, the aerosolized fuel 327 has a median particle size of about 0.6 micron and is in the nature of a visible white gas.

The air-to-fuel ratio can be adjusted by the amount of air allowed to flow into passage 329. Member 328 can be moved toward tube 312 so that the annular opening 329A around the outlet end of the tube is reduced in size, thereby adjusting the amount of air that flows into passage 329. Other types of adjusting structure can be used to control the amount of air that flows through passage 329.

The aerosolized fuel 327 mixed with air enters combustion area 332 where it burns as a flame 333. Suitable ignition means, as a spark plug or igniter (not shown), can be used to initiate combustion. The combustion area 332 has an elongated shape and is formed by member 328. A heat exchanger can be located adjacent the combustion area whereby the heat of the flame 333 can be transferred to a heat carrying medium, as air, gas or a liquid.

While there have been shown and described preferred embodiments of the apparatus and method for atomizing, vaporizing, condensing and aerosolizing fuel for use in heating burners, it is understood that changes, modifications and alterations can be made to the apparatus and method by those skilled in the art without departing from the invention.

The embodiments of the invention in which an exclusive property or privilege is claimed are defined as follows:

1. A method of burning combustible fuel comprising: providing a supply of liquid fuel, vaporizing the liquid fuel to change the fuel from a liquid phase to a vapor phase, condensing the fuel from the vapor phase to aerosol fuel by rapid mixing of air with the vapor phase fuel to form aerosol fuel particles, the majority of said aerosol fuel particles having a particle size of less than 1 micron in diameter, and burning the aerosol fuel particles in air.

2. The method of claim 1 wherein: the liquid fuel is heated to change the fuel from a liquid phase to a vapor phase.

3. The method of claim 2 wherein: the liquid fuel is under pressure during the heating thereof.

4. The method of claim 3 wherein: the liquid fuel is subjected to a substantial reduction of pressure to change the fuel from a liquid phase to a vapor phase.

5. The method of claim 1 wherein: the fuel is mixed with air by rapidly introducing air into the vapor phase fuel during condensing of the vapor phase fuel to form aerosol fuel particles.

6. The method of claim 1 wherein: the liquid fuel is under pressure during heating, said fuel being subjected to a reduction of pressure and rapid expansion during vaporization.

7. The method of claim 6 wherein: the vapor phase fuel is further mixed with air during condensing of the vapor phase fuel.

8. The method of claim 1 wherein: the liquid fuel is atomized into small liquid particles before said fuel is vaporized into vapor phase fuel.

9. The method of claim 8 including: mixing air with the atomized liquid fuel before the liquid fuel is vaporized into vapor phase fuel.

10. The method of claim 8 wherein: the liquid fuel particles are directed toward a hot surface so that the heat from said surface vaporizes the fuel into vapor phase fuel.

11. The method of claim 10 wherein: the hot surface has a cylindrical shape.

12. The method of claim 1 wherein: the liquid fuel is atomized into small particles and subjected to a hot gas during the vaporization of the liquid fuel.

13. The method of claim 1 wherein: the liquid fuel is subjected to pressure and metered into a chamber having hot gases whereby the liquid fuel is vaporized into vapor phase fuel.

14. A method of burning combustible fuel comprising: providing a supply of liquid fuel, vaporizing the liquid fuel to change the liquid fuel from a liquid phase to a vapor phase by directing the liquid fuel into a passage and heating said liquid fuel in the passage with hot combustion gases, condensing the fuel from the vapor phase to aerosol fuel by rapid mixing of air with the vapor phase fuel to form aerosol fuel particles, the majority of said aerosol fuel particles having a particle size of less than one micron in diameter, and burning the aerosol fuel particles in air.

15. The method of claim 14 wherein: liquid fuel and air are burned in a chamber connected to the passage to provide said hot combustion gases.

16. The method of claim 15 wherein: the burning of the aerosol takes place in a combustion chamber having an exhaust opening.

17. The method of claim 14 wherein: the burning of the aerosol takes place in a combustion chamber having an exhaust opening.

18. The method of claim 14 including: adding air to the aerosol fuel particles prior to the burning of the aerosol fuel particles.

19. The method of claim 14 wherein: the liquid fuel is subjected to a substantial reduction of pressure as it is directed into the passage.

20. The method of claim 14 wherein: the liquid fuel is atomized into small liquid particles before said fuel is vaporized into vapor phase fuel.

21. An apparatus for providing aerosol fuel to a combustion area for burning the aerosol fuel compriing: means having a combustion area, first means for changing a liquid fuel to a vapor phase fuel, means for supplying liquid fuel to the first means, and second means for receiving vapor phase fuel from the first means and rapidly mixing air with the vapor phase fuel to change the vapor phase fuel to aerosol fuel particles, the majority of said aerosol fuel particles having a particle size of less than one micron in diameter, and delivering the mixture of aerosol fuel particles and air to the combustion area.

22. The apparatus of claim 21 wherein: the first means includes tube means for carrying liquid fuel and means to heat the tube means to a temperature above the vaporizing temperature of the fuel in the tube means.

23. The apparatus of claim 22 wherein: the tube means is shaped as a coil.

24. The apparatus of claim 21 wherein: the first means includes tubular means and a nozzle having a small discharge orifice, means to heat the tubular means to a temperature above the vaporizing temperature of the fuel in the tubular means, said means for supplying the liquid fuel to the first means including means to increase the pressure of the fuel in the tubular means whereby hot liquid fuel is discharged through the orifice to the second means, said hot liquid fuel on being discharged through the orifice changing to vapor phase fuel.

25. The apparatus of claim 24 wherein: the tubular means is shaped as a coil.

26. The apparatus of claim 21 wherein: the first means includes means to heat the liquid fuel above the vaporizing temperature of the liquid fuel.

27. The apparatus of claim 21 wherein: the first means includes a tube having an inside surface for receiving liquid fuel and means to heat the tube to a temperature wherein the liquid fuel directed toward the inside surface is changed to vapor phase fuel.

28. The apparatus of claim 27 including: nozzle means for discharging liquid fuel toward the inside surface.

29. The apparatus of claim 21 wherein: the first means includes a housing having a chamber, means for discharging liquid fuel into the chamber, and means for directing hot gas into the chamber, said hot gas changing the liquid fuel to vapor phase fuel.

30. The apparatus of claim 29 wherein: the means for discharging liquid fuel into the chamber comprises at least one nozzle for discharging a spray of liquid fuel into the chamber.

31. An apparatus for providing aerosol fuel to a combustion area for burning the aerosol fuel comprising: a means having a combustion area, first means for changing a liquid fuel to a vapor phase fuel, first means including a member having a passage, a housing having a chamber connected to the member, said passage being in communication with the chamber, means for introducing charges of fuel into the chamber to form hot gases which flow through the passage, and means to introduce liquid fuel into the passage whereby said hot gases change the liquid fuel to vapor phase fuel, and second means for receiving vapor phase fuel from the first means and rapidly mixing air with the vapor phase fuel to change the vapor phase fuel to aerosol fuel particles and delivering the mixture of aerosol fuel particles and air to the combustion area.

32. The apparatus of claim 31 wherein: the means for introducing charges of fuel into the chamber include a nozzle and pump means to supply liquid fuel to the nozzle.

33. The apparatus of claim 31 wherein: the means to introduce liquid fuel into the passage includes tank means for storing liquid fuel, means connecting the passage with the tank to supply gas pressure to the tank, and line means connecting the tank and member for carrying liquid fuel from the tank to the passage.

34. The apparatus of claim 33 including: means in the line means to control the rate of flow of liquid fuel through the line means and into the passage.

35. The apparatus of claim 31 including: means to initially ignite the charges of fuel in the chamber, said fuel introduced into the chamber after initial ignition being self ignited intermittently to form said hot gases.

36. The apparatus of claim 31 including: means having a combustion chamber for receiving the air and aerosol fuel particles, said aerosol fuel particles being burned in said combustion chamber.

37. The apparatus of claim 21 wherein: the second means includes means for discharging air into the vapor phase fuel.

38. The apparatus of claim 37 wherein: the means for discharging air includes a manifold for receiving air under pressure, and means for carrying the air from the manifold to a passage carrying the vapor phase fuel.

39. The apparatus of claim 37 including: third means for discharging air into the mixture of air and aerosol fuel particles before the aerosol fuel particles are supplied to a combustion chamber.

40. The apparatus of claim 21 wherein: the first means includes a nozzle for atomizing the liquid fuel into small liquid particles.

41. The apparatus of claim 21 including: means having a combustion chamber for receiving the air and aerosol fuel particles, said aerosol fuel particles being burned in said combustion chamber.

* * * * *